United States Patent [19]

Malchow

[11] 3,996,665

[45] Dec. 14, 1976

[54] HOLDER FOR DETACHABLE BLADES

[75] Inventor: Douglas B. Malchow, Minneapolis, Minn.

[73] Assignee: Warner Manufacturing Company, Minneapolis, Minn.

[22] Filed: May 8, 1975

[21] Appl. No.: 575,786

[52] U.S. Cl. ..... 30/331; 30/334

[51] Int. Cl.[2] ..... B26B 5/00

[58] Field of Search ..... 30/334, 331, 330

[56] References Cited

UNITED STATES PATENTS

| | | | |
|---|---|---|---|
| 908,225 | 12/1908 | Edwards | 30/331 |
| 949,542 | 2/1910 | Levalley | 30/331 |
| 1,035,548 | 8/1912 | Dickenson | 30/330 |
| 1,347,234 | 7/1920 | Stebbins | 30/331 |
| 1,351,987 | 9/1920 | Barro | 30/330 |
| 1,367,611 | 2/1921 | Lochman | 30/330 |
| 1,575,608 | 3/1926 | Alberty et al. | 30/330 |
| 1,823,001 | 9/1931 | Rassier | 30/331 |
| 2,104,276 | 1/1938 | Schmidt | 30/331 |
| 2,601,523 | 6/1952 | Hill | 30/330 |
| 2,758,373 | 8/1956 | Guarino | 30/331 |

FOREIGN PATENTS OR APPLICATIONS

| | | | |
|---|---|---|---|
| 290,062 | 5/1928 | United Kingdom | 30/331 |

*Primary Examiner*—Al Lawrence Smith
*Assistant Examiner*—J. T. Zatarga

[57] ABSTRACT

A handle having a base member mounted on one end and a blade retainer member pivotally mounted on the base member. The base and retainer members have skirt portions for engagement with opposite side surfaces of a safety razor-type cutting blade, the retainer member being pivotally movable toward and away from a blade retaining position. Lugs on the base member are adapted to engage notches on a blade to lock the blade against movement relative to the base member.

1 Claim, 6 Drawing Figures

HOLDER FOR DETACHABLE BLADES

BACKGROUND OF THE INVENTION

This invention relates to knives or detachable blade holders for use with safety razor-type cutting blades. Such blade holders are known, some utilizing a pair of resilient flanges for holding a blade slidably inserted therebetween. Others employ a pair of plate-like clamping members releasably held in clamping relationship by one or more thumb screws or similar fastenings.

SUMMARY OF THE INVENTION

The blade holder of this invention involves a handle, a base member mounted on the handle, a retainer member, and means pivotally mounting the retainer member on the base member for movements toward and away from a blade retaining position. The base and retainer members include elongated skirt portions for face-to-face engagement with opposite side surfaces of a cutting blade. The base member is provided with protuberance means projecting therefrom in a direction transversely of the plane of the base member skirt portion for locking engagement with a portion of a cutting blade when the blade is engaged by the skirt portion.

DESCRIPTION OF THE PREFERRED EMBODIMENT

Figure 1:
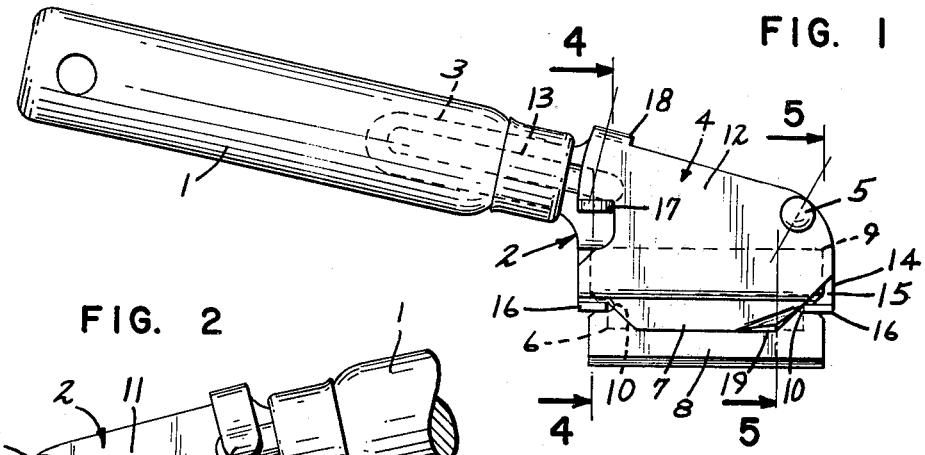
FIG. 1 is a view in front elevation of a holder for detachable blades produced in accordance with this invention.

The blade holder of this invention involves an elongated handle 1 to one end of which is rigidly secured a base member 2, preferably stamped from sheet metal to provide a shank 3 which is embedded in the handle 1, the base member 2 projecting longitudinally outwardly of the handle 1. A retainer member 4, also preferably stamped from sheet metal, is pivotally connected at its outer end portion to the outer end portion of the base member 2, by means of a rivet or the like 5.

As shown, the base and retainer members 2 and 4 are disposed in face-to-face relationship, and are formed adjacent their bottom edges to provide elongated skirt portions 6 and 7 respectively that are disposed to engage opposite side surfaces of a cutting blade 8. The blade 8 may be any one of a number of safety razor-type blades, the blade shown being of the single edge variety having a reinforcing back member 9 and notches 10 at its opposite ends. This blade is commonly known as an industrial blade, not used for shaving, but for general cutting purposes only.

Figure 4:
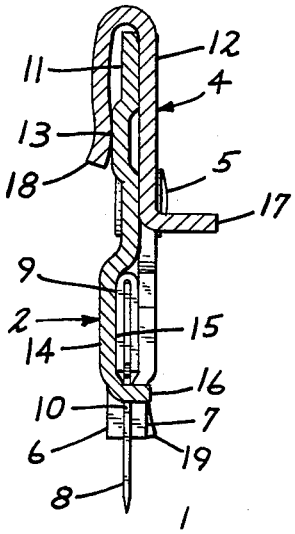
FIGS. 4 and 5 are enlarged fragmentary sections taken on the lines 4—4 and 5—5 respectively, of FIG. 1.
Figure 5:
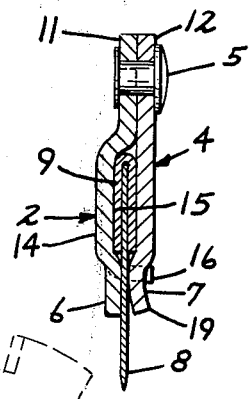

Upwardly of the skirt portions 6 and 7, the base and retainer members 2 and 4 have flat upper portions 11 and 12 respectively that are parallel with the skirt portions 6 and 7, and that are disposed in face-to-face sliding engagement with each other. The portion 11 is formed to provide a reinforcing rib 13 that extends longitudinally of the shank 3. Above the skirt portion 6, the base member 2 is formed to provide a longitudinally extending offset portion 14 which cooperates with the opposite portion of the retainer member 4 to define a longitudinal recess 15 for reception of the upper portion of the cutting blade 8, as shown in FIGS. 4 and 5. Further, the base member 2 is provided with protuberance means in the nature of a pair of lugs 16 that project transversely outwardly at opposite ends of the skirt portion 6, the lugs 16 being receivable in the notches 10 of the blade 8 to positively hold the blade 8 against movements relative to the holder when held therein.

Figure 2:
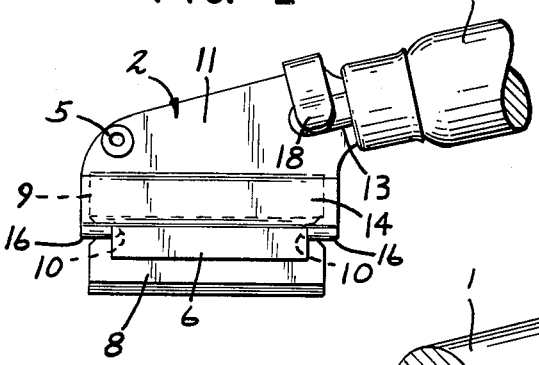
FIG. 2 is a fragmentary view in rear elevation.
Figure 3:
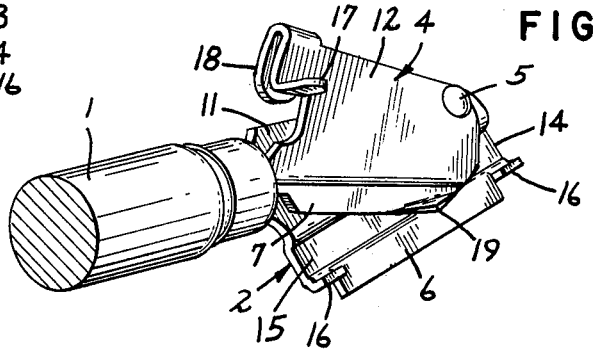
FIG. 3 is a fragmentary view in perspective, some parts being removed, and showing a different position of one of the parts.
Figure 6:
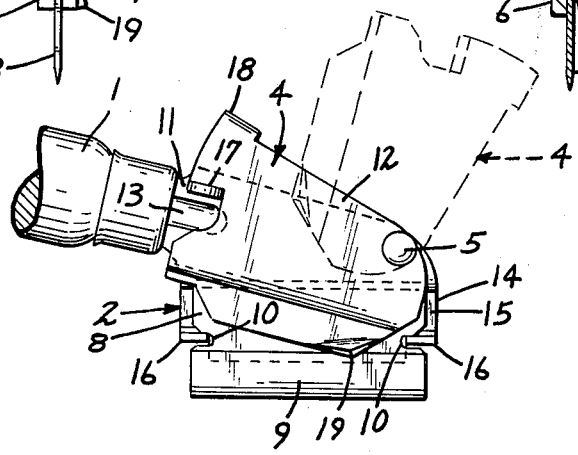
FIG. 6 is a view corresponding to a portion of FIG. 1 but showing a different position of some of the parts.

The retainer member 4 is pivotally movable on the axis of the rivet 5, between a blade holding position, showning FIGS. 1, 2, 4 and 5, and a blade releasing position shown by dotted lines in FIG. 6. For imparting pivotal movement to the retainer member 4 between its blade holding and release positions, the retainer member 4 is formed to provide a laterally outwardly projecting operating lug or tab 17 at the inner end of the retainer member 4. The inner end of the retainer member 4 is further formed to provide a downwardly opening hook portion 18 for reception of the upper portion of the base member 2 adjacent the neck 3 thereof to hold the inner end of the retainer member 4 in face-to-face engagement with the base member 2. As shown in FIGS. 2 and 4, the hook portion 18 engages the rib 13 to provide holding engagement.

In use, a blade 8 is placed against the front side of the base member 2 when the retainer member 4 is moved to its dotted line position of FIG. 6, so that the reinforcing member 9 is contained within the recess 15 and with the lugs 16 disposed within respective ones of the blade notches 10. The retainer member 4 is then pivotally moved to its operative blade holding position of FIGS. 1, 2, 4 and 5. It will here be noted that the skirt portion 7 is provided with an outturned guide lip 19 that initially engages the reinforcing member 9 of the blade 8 to move the skirt portion 7 laterally outwardly so that the same may pass downwardly over the reinforcing member 9 toward engagement with the adjacent side surface of the blade 8. There is sufficient resilience in the material of the retainer member 4 to permit this laterally outward movement of the skirt portion 7 and adjacent portions of the retainer member 4. It will be further noted that the members 2 and 4 are sufficiently rigid to support the blade 8 against lateral deflection during use. As above indicated, the lugs 16 positively hold the blade 8 against movement relative to the holder in all directions parallel to the plane of the blade 8. When not in use, the blade 8 may be inverted with respect to the holder, so that the cutting edge portion of the blade is received in the recess 15, with the backing member 9 disposed below the skirt portions 6 and 7, as shown in FIG. 6. Although, in FIG. 6, the retainer member 4 is shown by full lines in a partial blade releasing position, the same may be moved to its position of FIGS. 1 and 2 when the blade 8 is in its inverted storage position.

While I have shown and described a preferred embodiment of my holder for detachable blades, it will be understood that the same is capable of modification without departure from the spirit and scope of the invention, as defined in the claims.

What is claimed is:

1. A holder for detachable blades, comprising:

a. an elongated handle;

b. a base member projecting longitudinally from one end of said handle and formed from sheet metal to provide a lower elongated flat skirt portion for face-to-face engagement with one side surface of a cutting blade, a pair of lugs projecting outwardly of said base member at opposite ends of said skirt portion for locking engagement with a portion of a cutting blade engaged by the skirt portion, a longitudinally extending portion above said skirt portion and said lugs laterally outwardly offset from said skirt portion, and a generally flat upper portion above said offset portion and laterally inwardly offset from said offset portion and parallel to said skirt portion;

c. a retainer member formed from sheet metal to provide a lower flat skirt portion for face-to-face engagement with the other side surface of a cutting blade in opposition to the base member skirt portion, and an upper portion laterally outwardly offset from its respective skirt portion and parallel thereto;

d. a pivot shaft disposed on an axis normal to the planes of said skirt portions pivotally mounting said retainer member on said base member at one end of said members in face-to-face engagement of said upper portions of the base and retainer members and for movements toward and away from a blade retaining position wherein said skirt portions are disposed in face-to-face relationship;

e. said retainer member having an upper edge and being further formed to provide a hook depending from said upper edge at the end of said retainer member opposite said pivot shaft for reception of a portion of said base member when said retainer member is moved to its blade-retaining position, and a laterally outwardly projecting operating lug generally opposite said hook;

f. said offset portions of said base and retainer members cooperating to define an open-ended passageway extending longitudinally of said skirt portions, said retainer member skirt portion having opposite end portions engaging said lugs to limit downward movement of said retainer member relative to said base member, said retainer member skirt portion further having a lower corner portion at an end thereof adjacent said pivot shaft formed to provide a generally triangular guide lip projecting in a direction angularly longitudinally and laterally outwardly and downwardly relative to its respective skirt portion.

* * * * *